US009837024B2

(12) United States Patent
Wang et al.

(10) Patent No.: US 9,837,024 B2
(45) Date of Patent: Dec. 5, 2017

(54) SCAN DRIVING CIRCUIT AND DRIVING METHOD THEREOF, ARRAY SUBSTRATE AND DISPLAY APPARATUS

(71) Applicant: BOE TECHNOLOGY GROUP CO., LTD., Beijing (CN)

(72) Inventors: Lirong Wang, Beijing (CN); Liye Duan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/101,184

(22) PCT Filed: Sep. 24, 2015

(86) PCT No.: PCT/CN2015/090552
§ 371 (c)(1),
(2) Date: Jun. 2, 2016

(87) PCT Pub. No.: WO2016/173197
PCT Pub. Date: Nov. 3, 2016

(65) Prior Publication Data

US 2017/0124955 A1 May 4, 2017

(30) Foreign Application Priority Data

Apr. 30, 2015 (CN) ..... 2015 1 0217777

(51) Int. Cl.
*G09G 3/3266* (2016.01)
*G09G 3/3225* (2016.01)

(52) U.S. Cl.
CPC ..... *G09G 3/3266* (2013.01); *G09G 3/3225* (2013.01); *G09G 2310/0267* (2013.01);
(Continued)

(58) Field of Classification Search
CPC ..... G09G 3/3266; G09G 3/3225; G09G 2310/0286; G09G 2310/08;
(Continued)

(56) References Cited

U.S. PATENT DOCUMENTS

2006/0271757 A1* 11/2006 Kim ..... G09G 3/3266 711/167
2008/0062071 A1* 3/2008 Jeong ..... G11C 19/184 345/46
2010/0321422 A1* 12/2010 Ishiguro ..... G09G 3/3233 345/698

FOREIGN PATENT DOCUMENTS

CN 1794331 A 6/2006
CN 102201194 A 9/2011
(Continued)

OTHER PUBLICATIONS

Search Report and Written Opinion dated Feb. 3, 2016 from State Intellectual Property Office of the P.R. China.

*Primary Examiner* — William Boddie
*Assistant Examiner* — Saifeldin Elnafia
(74) *Attorney, Agent, or Firm* — Dilworth & Barrese, LLP.; Michael J. Musella, Esq.

(57) ABSTRACT

A scan driving circuit and a driving method thereof, an array substrate, and a display apparatus are disclosed. The scan driving circuit comprises: a first shift register (11) connected to one group of clock signals (CLKA) having a first clock cycle, and configured to output a first scanning signal (GA) progressively; a second shift register (12) connected to another group of clock signals (CLKB) having a second clock cycle, and configured to output a second scanning signal (GB) progressively; and a logic arithmetic device (13) connected to a first clock signal (CLK1) having a third clock cycle, connected to the first shift register (11) and the second shift register (12), and configured to output compensation
(Continued)

signals (SC) of multiple rows; the compensation signal (SC) of any row has a wave shape the same as the first clock signal (CLK1) when a second scanning signal (GB) of a present row is at a first level, and has a wave shape the same as a first scanning signal (GA) of the present row when the second scanning signal (GB) of the present row is at a second level; and the third clock cycle is smaller than the second clock cycle. The scan driving circuit can be implemented by adding an appropriate circuit structure on the basis of the conventional GOA circuit, without manufacturing a driving chip on the external circuit board, so that the manufacturing process can be simplified, the process cost of products can be reduced, and integration level of the OLED panel can be raised.

19 Claims, 4 Drawing Sheets

(52) U.S. Cl.
CPC ..... *G09G 2310/0283* (2013.01); *G09G 2310/0286* (2013.01); *G09G 2310/08* (2013.01)

(58) Field of Classification Search
CPC ... G09G 2310/0283; G09G 2310/0267; G09G 2320/0233; G09G 2320/0223
See application file for complete search history.

(56) References Cited

FOREIGN PATENT DOCUMENTS

| | | |
|---|---|---|
| CN | 104766587 A | 7/2015 |
| EP | 1777688 B1 | 8/2014 |

* cited by examiner

SCAN DRIVING CIRCUIT AND DRIVING METHOD THEREOF, ARRAY SUBSTRATE AND DISPLAY APPARATUS

TECHNICAL FIELD

The present disclosure relates to a scan driving circuit and a driving method thereof, an array substrate, and a display apparatus.

BACKGROUND

With the fast development of thin film transistor liquid crystal display (TFT-LCD), respective manufacturers compete to adopt new technologies to enhance market competitiveness of products and reduce cost of the products. Herein, GOA (Gate Driver On Array) technology, as a representative of the new technologies, integrates on an array substrate the scan driving circuits in a row direction, which avoids manufacturing a driving chip on an external circuit board, so that a manufacturing process is simplified, process cost of products is reduced, and integration level of the TFT-LCD panel is raised.

However, when applying the GOA technology to a display apparatus in a type of an organic light-emitting display (OLED), the GOA circuit may be incapable of providing all of signals required for displaying and driving due to the limitation of structure and function. Exemplarily, as for several OLED pixel circuits having a threshold voltage compensation function, it requires to use compensating signals outputted, progressively, along the row direction (it generally comprises several pulses of firs type and one pulse of second type in a time sequence), but such compensation signals cannot be provided by a conventional GOA circuit. Based on this problem, the known technology always needs to manufacture a chip for generating this compensation signals on the external circuit board, so that the production process becomes complicated and cost of products increases.

SUMMARY

There are provided in the present disclosure a scan driving circuit and a driving method thereof, an array substrate, and a display apparatus, which can solve the problem that a conventional GOA circuit cannot provide compensation signals.

According to a first aspect, there is provided in the present disclosure a scan driving circuit, comprising: a first shift register connected to one group of clock signals having a first clock cycle and configured to output a first scanning signal, progressively, driven by the one group of clock signals; a second shift register connected to another group of clock signals having a second clock cycle and configured to output a second scanning signal, progressively, driven by the another group of clock signals; a logic arithmetic device connected to a first clock signal having a third clock cycle, connected to the first shift register and the second shift register, and configured to output compensation signals of multiple rows; a compensation signal of any row has a wave shape the same as the first clock signal when a second scanning signal of a present row is at a first level, and has a wave shape the same as a first scanning signal of the present row when the second scanning signal of the present row is at a second level; and the third clock cycle is smaller than the second clock cycle.

Optionally, corresponding to the compensation signal of any row, the logic arithmetic device comprises a first AND arithmetic unit, a second AND arithmetic unit, a NOT arithmetic unit and an OR arithmetic unit, wherein the first AND arithmetic unit is connected to the first clock signal and the second shift register and configured to perform logic AND arithmetic on the first clock signal and the second scanning signal of the present row, to obtain a first arithmetic signal; the NOT arithmetic unit is connected to the second shift register and configured to perform logic NOT arithmetic on the second scanning signal of the present row, to obtain a second arithmetic signal; the second AND arithmetic unit is connected to the NOT arithmetic unit and the first shift register and configured to perform logic AND arithmetic on the first scanning signal of the present row and the second arithmetic signal from the NOT arithmetic unit, to obtain a third arithmetic signal; and the OR arithmetic unit is connected to the first AND arithmetic unit and the second AND arithmetic unit, and is configured to perform logic OR arithmetic on the first arithmetic signal from the first AND arithmetic unit and the third arithmetic signal from the second AND arithmetic unit, to obtain the compensation signal of the present row.

Optionally, the first shift register comprises multiple stages of first shift register units connected in sequence, and any stage of first shift register unit except a first stage of first shift register unit is configured to delay and output a first scanning signal of a previous row from a previous stage of shift register unit as the first scanning signal of the present row driven by the one group of clock signals having the first clock cycle; the second shift register comprises multiple stages of second shift register units connected in sequence, and any stage of second shift register unit except a first stage of second shift register unit is configured to delay and output a second scanning signal of a previous row from a previous stage of shift register unit as the second scanning signal of the present row driven by the other group of clock signals having the second clock cycle.

Optically, the logic arithmetic device comprises a plurality of sub logic arithmetic devices, any one of which is corresponding to a stage of first shift register unit and a stage of second shift register unit; the sub logic arithmetic device comprises a first transistor, a second transistor, an inverter and an output terminal, wherein a gate of the first transistor is connected to the second scanning signal outputted by the second shift register unit, one of source and drain thereof is connected to the first clock signal having the third clock cycle, and the other is connected to the output terminal; an input end of the inverter is connected to the second scanning signal outputted by the second shift register unit, and an output end thereof is connected to a gate of the second transistor; one of source and drain of the second transistor is connected to the first scanning signal outputted by the first shift register unit, and the other is connected to the output terminal.

Optionally, the first shift register unit has a circuit structure the same as the second shift register unit.

Optionally, the one group of clock signals having the first clock cycle comprises m clock signals whose phases have a different of 1/m first clock cycle in sequence; the other group of clock signals having the second clock cycle comprises n clock signals whose phases have a difference of 1/n second clock cycle in sequence; both the m and n are integers greater than or equal to 2.

Optionally, the third clock cycle, the m and the n are set according to a wave shape of the compensation signal.

According to a second aspect, there is further provided in the present disclosure a driving method of any one of the scan driving circuit described above, comprising: inputting a first start signal to the second shift register before a rising edge of a second clock signal, so that the second shift register starts outputting a second scanning signal, progressively; the second clock signal being one clock signal of a group of clock signals connected to the second shift register; inputting a second start signal to the first shift register after the rising edge of the second clock signal, so that the first shift register starts outputting a first scanning signal, progressively; and a time that the second scanning signal of any row is converted from a first level to a second level being not later than a time that the first scanning signal of the row starts outputting.

According to a third aspect, there is further provided in the present disclosure an array substrate comprising any one of the scan driving circuit described above.

According to a fourth aspect, there is further provided in the present disclosure a display apparatus, comprising any one of the array substrate described above or any one of the scan driving circuit described above.

It can be known from the above technical solution that the scan driving circuit provided in the present disclosure can generate a compensation signal having a specific wave shape under an appropriate setting of signal timing. Exemplarily, the wave shape of the compensation signal within part time coincides with the wave shape of the clock signal, and the wave shape of the compensation signal within other time coincides with the wave shape of the scanning signal, and thus the compensation signal can comprise several pulses of first type (from the clock signal) and one pulse of second type (from the scanning signal), so as to provide a compensation signal required for a variety of OLED pixel circuits.

Compared with the known technique, the present disclosure can be implemented by adding an appropriate circuit structure on the basis of the conventional GOA circuit, without manufacturing a driving chip on the external circuit board, so that the manufacturing process can be simplified, the process cost of products can be reduced, and integration level of the OLED panel can be raised.

BRIEF DESCRIPTION OF THE DRAWINGS

In order to describe technical solutions in embodiments of the present disclosure or in the prior art more clearly, figures needed to be used in the description of the embodiments or the prior art will be introduced briefly.

DETAILED DESCRIPTION

Technical solutions in embodiments of the present disclosure will be described clearly and completely by combing with figures in the embodiments of the present disclosure. Obviously, the embodiments described below are just a part of embodiments of the present disclosure, but not all of the embodiments of the present disclosure. Based on the embodiments of the present disclosure, all of other embodiments obtained by those skilled in the art without paying any inventive labor belong to the scope sought for protection in the present disclosure.

Figure 1:
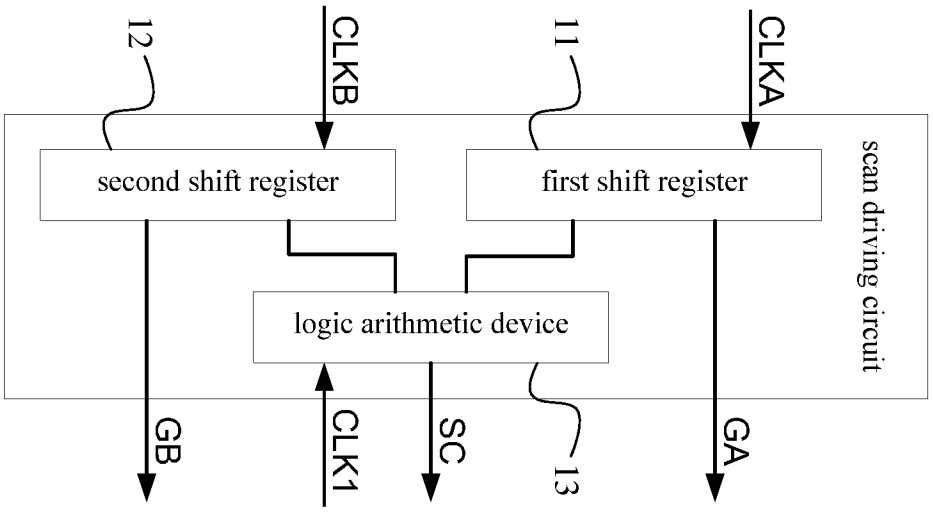
FIG. 1 is a block diagram of a structure of a scan driving circuit in an embodiment of the present disclosure.

FIG. 1 is a block diagram of a structure of a scan driving circuit in an embodiment of the present disclosure. Referring to FIG. 1, the circuit comprises a first shift register 11, a second shift register 12, and a logic arithmetic device 13. Herein, the first shift register 11 is connected to a group of clock signals CLKA having a first clock cycle T1 and configured to output a first scanning signal GA, progressively, driven by the group of clock signals CLKA. The second shift register 12 is connected to the another group of clock signals CLKB having a second clock cycle T2 and configured to output a second scanning signal GB, progressively, driven by the other group of clock signals CLKB.

The logic arithmetic device 13 is connected to a first clock signal CLK1 having a third clock cycle T3 (the third clock cycle T3 is smaller than the second clock cycle T2, that is, a frequency of the CLK1 is greater than a frequency of all of clock signals in the CLKB), and connected to the first shift register 11 and the second shift register 12 and is configured to output a compensation signal SC of multiple rows. It is not shown in FIG. 1 that a compensation signal SC_N of a N-th row (N is any integer not smaller than 1) has a wave shape the same as the first clock signal CLK1 when a second scanning signal GB_N of a present row is at a first level VH, and has a wave shape the same as a first scanning signal GA_N of the present row when the second scanning signal GB_N of the present row is at a second level VL. It should be understood that the compensation signal SC having the above characteristic can be obtained by performing logic arithmetic on the first scanning signal GA, the second scanning signal GB and the first clock signal CLK1. Therefore, the above logic arithmetic device 13 can be implemented by any circuit structure having corresponding logic arithmetic functions, to which the present disclosure does not limit.

It may be understood that the scan driving circuit needs to provide corresponding output signals to multiple rows of pixels respectively. Therefore, "row" is actually unit division of output signals of the scan driving circuit. Assuming that the scan driving circuit is corresponding to Ln rows of pixels, then a number of rows possessed by the "first scanning signals of multiple rows", "second scanning signals of multiple rows" and "compensation signals of multiple rows" can be La (La≤Ln), Lb(Lb≤Ln), and Lc (Lc≤min (La, Lb) respectively, where min(a, b) represents a smaller one of a and b. Of course, La, Lb, and Lc may be any positive integer within the above range, and may be equal to Ln at the same time. Those skilled in the art can select values of La, Lb, and Lc according to the actual requirements, and can arrange structures of the first shift register 11, the second shift register 12 and the logic arithmetic device 13 adaptively, to which the present disclosure does not limit.

It further needs to note that for the first scanning signal GA and the second scanning signal GB, the scan driving circuit can be used for only the logic arithmetic device 13 but does not perform outputting, or the first scanning signal GA and the second scanning signal GB can be outputted together with the compensation signal SC as shown in FIG. 1, to which the present disclosure does not limit.

It can be seen that the scan driving circuit provided in the embodiments of the present disclosure can generate a compensation signal having a specific wave shape under the appropriate setting of signal timing. Exemplarily, the wave shape of the compensation signal within part time coincides with the wave shape of the clock signal, and the wave shape of the compensation signal within other time coincides with the wave shape of the scanning signal, and thus the compensation signal can comprise several pulses of first type (from the clock signal) and one pulse of second type (from the scanning signal), so as to provide required compensation signals for a variety of OLED pixel circuits.

Compared with the known technique, the present disclosure can be implemented by adding an appropriate circuit structure on the basis of the conventional GOA circuit, without manufacturing a driving chip on the external circuit board, so that the manufacturing process can be simplified, the process cost of products can be reduced, and integration level of the OLED panel can be raised.

Figure 2:
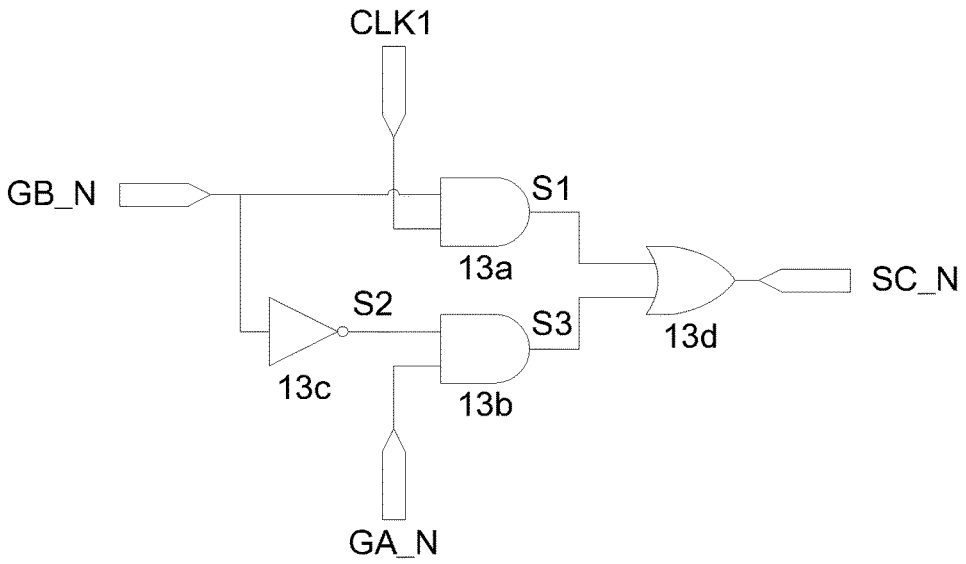
FIG. 2 is a schematic diagram of a structure of a logic arithmetic device in a scan driving circuit in an embodiment of the present disclosure.

As an example, FIG. 2 is a schematic diagram of a structure of a logic arithmetic device in a scan driving circuit in an embodiment of the present disclosure. Referring to FIG. 2, corresponding to the compensation signal SC_N of any row, the logic arithmetic device 13 in the embodiment of the present disclosure comprises a first AND arithmetic unit 13*a*, a second AND arithmetic unit 13*b*, a NOT arithmetic unit 13*c* and an OR arithmetic unit 13*d*, wherein the first AND arithmetic unit 13*a* is connected to the first clock signal CLK1 and the second shift register 12, and is configured to perform logic AND arithmetic on the first clock signal CLK1 and the second scanning signal GB_N of the present row, to obtain a first arithmetic signal S1. It can be seen that in terms of logic arithmetic relationship, there is S1=CLK1·GB_N.

The NOT arithmetic unit 13*c* is connected to the second shift register 12, and is configured to perform logic NOT arithmetic on the second scanning signal GB_N of the present row, to obtain a second arithmetic signal S2. It can be seen that in terms of logic arithmetic relationship, there is S2=$\overline{\text{GB_N}}$.

The second AND arithmetic unit 13*b* is connected to the NOT arithmetic unit 13*c* and the first shift register 13*a*, and is configured to perform logic AND arithmetic on the first scanning signal GA_N of the present row and the second arithmetic signal S2 from the NOT arithmetic unit 13*c*, to obtain a third arithmetic signal S3. It can be seen that in terms of logic arithmetic relationship, there is S3=S2·GA_N=$\overline{\text{GB_N}}$·GA_N.

The OR arithmetic unit 13*d* is connected to the first AND arithmetic unit 13*a* and the second AND arithmetic unit 13*b*, and is configured to perform logic OR arithmetic on the first arithmetic signal S1 from the first AND arithmetic unit 13*a* and the third arithmetic signal S3 from the second AND arithmetic unit 13*b*, to obtain the compensation signal SC_N of the present row. It can be seen that in terms of logic arithmetic relationship, there is SC_N=S1+S3=GB_N·CLK1+$\overline{\text{GB_N}}$·GA_N.

It can be seen that the logic arithmetic relationship is consistent with the above description of "a compensation signal SC_N of a N-th row (N is any integer not smaller than 1) has a wave shape the same as the first clock signal CLK1 when the second scanning signal GB_N of the present row is at the first level VH, and has a wave shape the same as the first scanning signal GA_N of the present row when the second scanning signal GB_N of the present row is at the second level VL". Herein, in the embodiment of the present disclosure, the first level VH is set as a high level of "1", and the second level VL is set as a low level of "0". However, it shall be understood that the first level VH and the second level VL can be set according to the actual requirements, but is not limited to the situation as shown in the embodiment of the present disclosure. Thus it can be seen that the function of the logic arithmetic device 13 can be implemented by the circuit comprising several logic arithmetic units.

Figure 3:
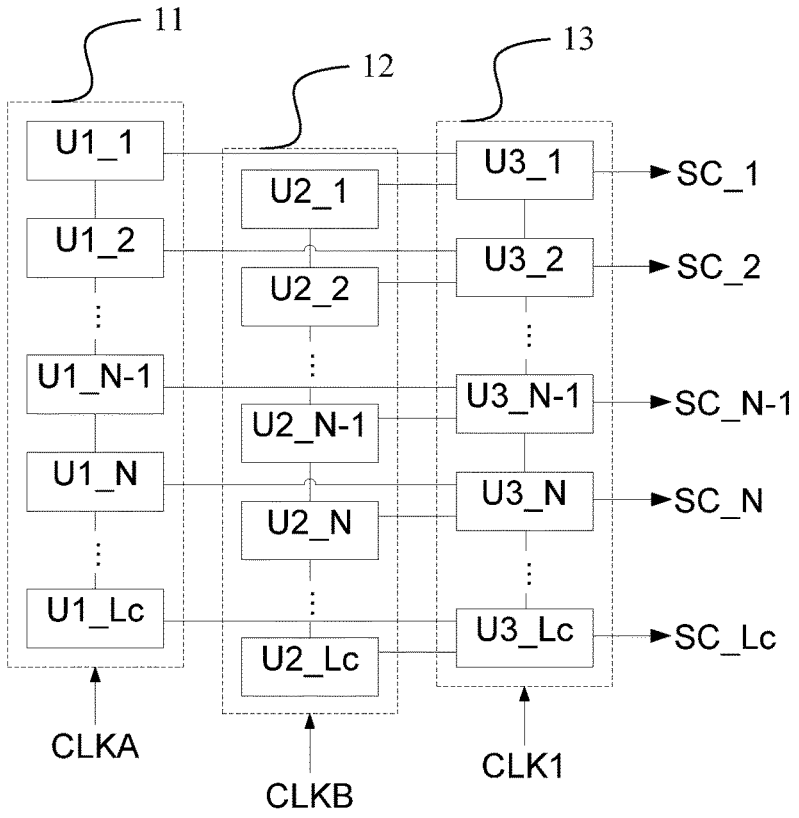
FIG. 3 is a schematic diagram of a circuit structure of a scan driving circuit in an embodiment of the present disclosure.

As an example, FIG. 3 is a schematic diagram of a circuit structure of a scan driving circuit in an embodiment of the present disclosure. As shown in FIG. 3, the first shift register 11 in the embodiment of the present disclosure comprises multiple stages of first shift register units connected in sequence (such as U1_1, U1_2, . . . , U1_N−1, U1_N, . . . , U1_Lc in FIG. 3). Any stage of first shift register unit U1_N except for the first stage of first shift register is configured to delay and output a first scanning signal GA_N−1 of a previous row from a previous stage of shift register unit U1_N−1 as the first scanning signal GA_N of the present row driven by one group of clock signals CLKA having the first clock cycle T1.

Similarly, the second shift register 12 in the embodiment of the present disclosure comprises multiple stages of second shift register units connected in sequence (such as U2_1, U2_2, . . . U2_N−1, U2_N, . . . U2_Lc in FIG. 3). Any stage of second shift register unit U2_N except for the first stage of second shift register is configured to delay and output a second scanning signal GB_N−1 of the previous row from a previous stage of shift register unit U2_N−1 as the second scanning signal GB_N of the present row driven by one group of clock signals CLKB having the second clock cycle T2.

Based on the above arrangement, the function of the first shift register can be implemented by connecting the first shift register units in cascades, and the function of the second shift register can be implemented by connecting the second shift register units in cascades.

In addition, the logic arithmetic device 13 in the embodiment of the present disclosure comprises a plurality of sub logic arithmetic devices (such as U3_1. U3_2, . . . U3_N−1, U3_N, . . . U3_Lc in FIG. 3). As for any N being not smaller than 2, the sub logic arithmetic device U3_N is connected to the first clock signal CLK1, and the first shift register unit U1_N and the second shift register unit U2_N, and is configured to output a compensation signal SC_N of the N-th row. That is, any sub logic arithmetic device is corresponding to one stage of the first shift register unit and one stage of the second shift register unit, respectively.

Figure 4:
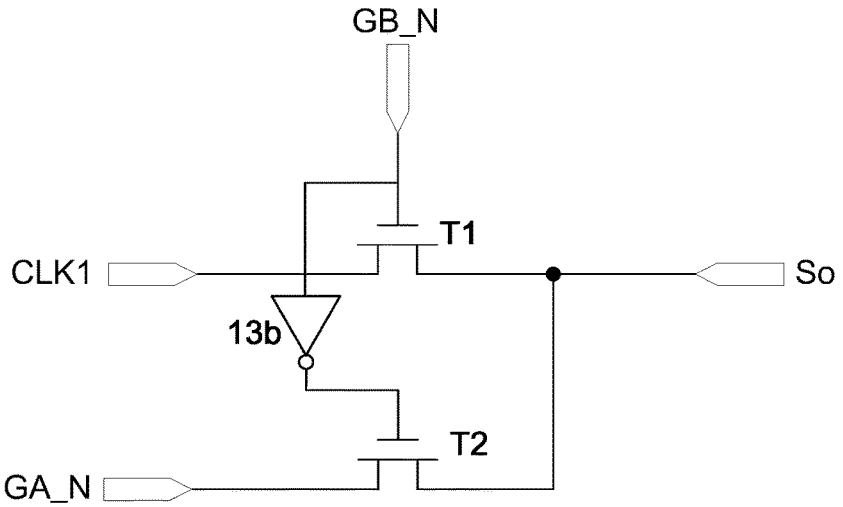
FIG. 4 is a schematic diagram of a circuit structure of a sub logic arithmetic device in the scan driving circuit in FIG. 3.

Exemplarily, FIG. 4 is a schematic diagram of a circuit structure of a sub logic arithmetic device in the scan driving circuit in FIG. 3. Referring to FIG. 4, the sub logic arithmetic device U3_N (N is any positive integer not smaller than 2) comprises a first transistor T1, a second transistor T2, an inverter 13*b* and an output terminal So, wherein a gate of the first transistor T1 is connected to the second scanning signal GB_N outputted by the second shift register unit U2_N, one of source and drain is connected to the first clock signal CLK1 having the third clock cycle T3, and the other is connected to the output terminal So.

An input end of the inverter 13*b* is connected to the second scanning signal GB_N outputted by the second shift register unit U2_N, and an output end thereof is connected to a gate of the second transistor T2.

One of source and drain of the second transistor T2 is connected to the first scanning signal GA_N outputted by the first shift register unit U1_N, and the other is connected to the output terminal So.

In the above sub logic arithmetic device U3_N, two logic AND operations are performed by two transistors T1 and T2, the logic OR arithmetic is realized by the connecting relationship of the output terminal So, and finally the function of the logic arithmetic device can be realized through a simple circuit structure. Each device in the circuit can be integrated on the array substrate, and the process of manufacturing the driving chip on the external circuit board can be avoided in the process of manufacturing.

It can be understood that the circuit structure as shown in FIG. 2 can be also used to form a sub logic arithmetic device, and the circuit structure as shown in FIG. 4 can be considered as an implementation of a logic gate circuit as shown in FIG. 2. Of course, base on the structure as shown in FIG. 2, those skilled in the art can obtain a sub logic arithmetic device in other forms by selecting a circuit structure of each unit, to which the present disclosure does not limit.

On the basis of any one of the scan driving circuit structures, the one group of clock signals CLKA having the first clock cycle T1 can comprise m clock signals CLKA_1, CLKA_2, . . . , CLKA_m whose phases have a difference of 1/m first clock cycle; the one group of clock signals CLKB having the second clock cycle T2 comprises n clock signals CLKB_1, CLKB_2, . . . , CLKB_n whose phases have a difference of 1/n second clock cycle, where both m and n are integers greater than or equal to 2. On such a basis, both the first shift register 11 and the second shift register 12 can operate under a multi-phase clock signal, and the multi-phase clock signal has higher reliability compared with the single-phase clock signal. Of course, the one group of clock signals CLKA having the first clock cycle T1 can comprise only one clock signal, and the one group of clock signals CLKB having the second clock cycle T2 comprises only one clock signal, which would not affect the implementation of the technical solutions of the present disclosure.

Figure 5:
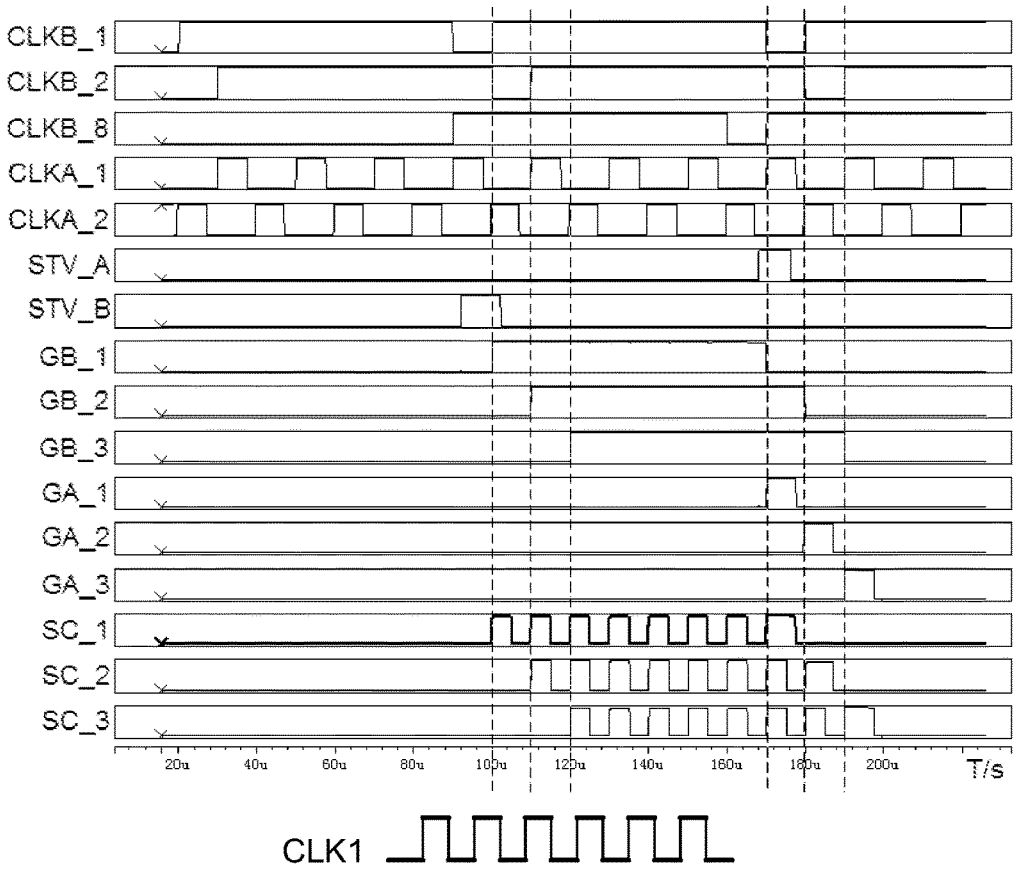
FIG. 5 is a schematic diagram of circuit timing of a scan driving circuit in an embodiment of the present disclosure.

Exemplarily, the third clock cycle T3, the m and the n are set according to the wave shape of the compensation signal. By taking m=2 and n=8 as an example, FIG. 5 is a schematic diagram of a circuit timing of a scan driving circuit in an embodiment of the present disclosure, wherein T/s represents that a unit of time axis is second. Referring to FIG. 5, the third clock cycle T3 is a half of the first clock cycle T1, while the first clock cycle T1 is a quarter of the second clock cycle T2. Thus, during the time that GB_1 is at the high level, the first clock signal CLK1 would output eight pulses (because the third clock cycle T3 is one eighth of the second clock cycle T2), while SC_1 would have a wave shape the same as the first clock cycle CLK1 during this time (i.e., eight "pulses of first type"). Under an appropriate setting, a falling edge of GB_1 can be aligned with the rising edge of GA_1, so that SC_1 comprises one pulse corresponding to GA_1 (i.e., one "pulse of second type"), so that the wave shape of the compensation signal as shown by SC_1 in FIG. 5 is formed. By taking the above procedure as an example, generations of other compensation signals are formed by similar processes. Thus it can be seen that a ratio of the third clock cycle T3 to the second clock cycle T2 determines how many pulses of first type (provided by the first clock signal CLK1) would be in the compensation signal; all of the clock signals in CLKA would determine what kind of pulse of second type is in the compensation signal by driving the first shift register 11. Therefore, those skilled in the art can adjust the respective parameters in the above scan driving circuit sequentially to obtain the required compensation signal.

It should be noted that the compensation signal would have at least one pulse of first type only if the third clock period T3 is smaller than the second clock period T2. Under the premise of satisfying this condition, the first clock cycle T1, the second clock cycle T2 and the third clock cycle T3 can be set arbitrarily as required.

Figure 6:
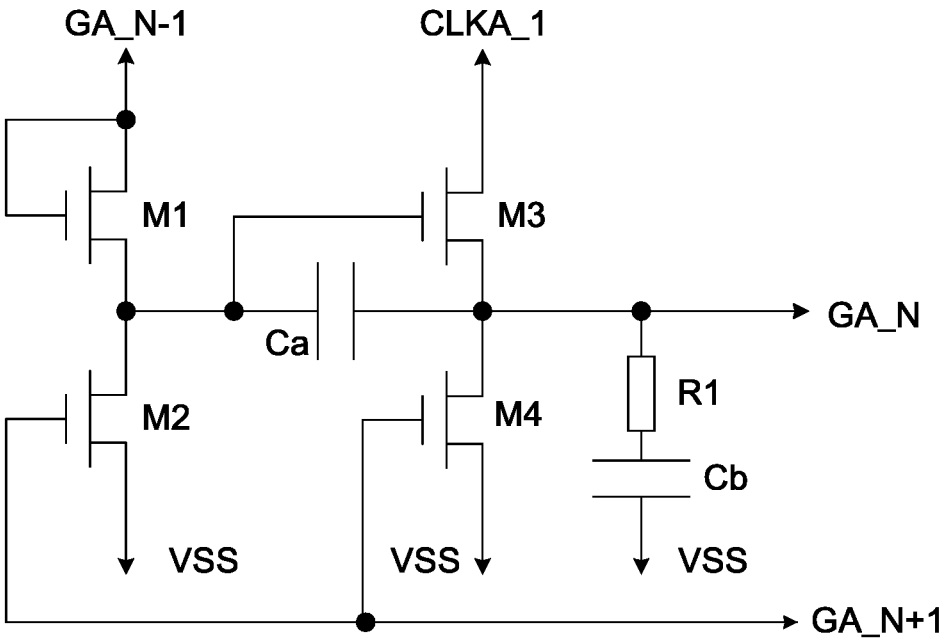
FIG. 6 is a schematic diagram of a circuit structure of a first shift register unit in an embodiment of the present disclosure.

On the other hand, the first shift register unit and the second shift register unit may have the same circuit structure. For example, FIG. 6 is a schematic diagram of a circuit structure of a first shift register unit in an embodiment of the present disclosure. Referring to FIG. 6, the first shift register unit U1_N comprises a first thin film transistor M1, a second thin film transistor M2, a third thin film transistor M3, a fourth thin film transistor M4, a first capacitor Ca, a second capacitor Cb and a resistor R1. Herein, one end of M2, M4 and Cb is connected to a power supply VSS, and M1 can be turned on when the high level of GA_N−1 comes, and pulls up a potential at a gate of M3; next, when M1, M2, and M4 are turned off and CLKA_1 is converted into the high level, the potential at the gate of M3 is further pulled up under the voltage maintaining effect of the first capacitor Ca, and at the same time, GA_N can also be converted into the high level. When GA_N+1 is converted into the high level, M2 and M4 would be in a turn-on state to pull down the potential at the gate of M3 and the potential at GA_N, so that GA_M is recovered to the low level. In the meantime, the second capacitor Cb and the resistor R1 can filter the output signal, to realize stability of signals of GA_N. Thus, this first shift register unit U1_N can complete an output of "low level-high level-low level" for one time. That is, "the first scanning signal GA_N−1 of previous row from the previous stage of shift register unit U1_N−1 is delayed and outputted as the first scanning signal GA_N of the present row driven by the one group of clock signals CLKA having the first clock cycle T1". Other shift register units are similar.

Corresponding to the circuit timing in FIG. 5, the first shift register units U1_1, U1_2, . . . , U1_N−1, U1_N, . . . , U1_Lc having the circuit structure as shown in FIG. 6 would be connected sequentially to CLAK_1, CLKA_2, CLKA_1, CLKA_2, . . . , while the second shirt register unit U2_1, U2_2, . . . , U2_N−1, U2_N, . . . , U2_Lc having the circuit structure as shown in FIG. 6 would be connected sequentially to CLKB_1, CLKB_2, CLKB_3, . . . , CLKB_7, CLKB_8, CLKB_1, CLKB_2, CLKB_3, . . . . On such a basis, when the first start signal STV_A as shown in FIG. 5 is inputted to the gate of M1 of U1_1, the first shift register 11 would, as shown by GA_1, GA_2, GA_3 in FIG. 5, output the first scanning signal GA, progressively, driven by CLKA_1 and CLKA_2. When the second start signal STV_B as shown in FIG. 5 is inputted to the gate of M1 of U2_1, the second shift register 12 would, as shown by GB_1, GB_2, GB3_3 in FIG. 5, output the second scanning signal GB, progressively, driven by CLKB_1 to CLKB_8.

Figure 7:
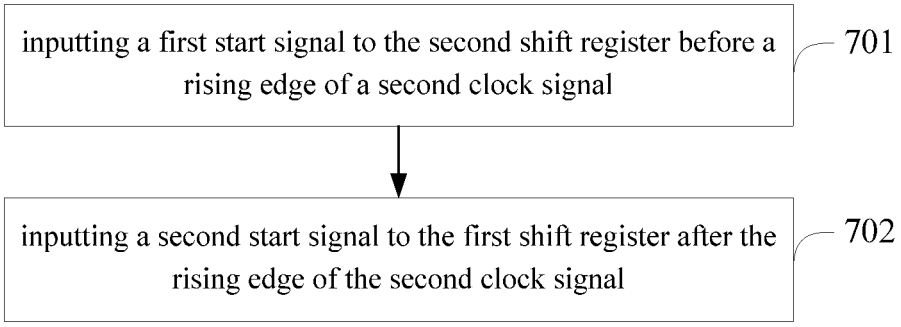
FIG. 7 is a process flowchart of a driving method of a scan driving circuit in an embodiment of the present disclosure.

Based on the same inventive concept, FIG. 7 is a process flowchart of a driving method of a scan driving circuit in an embodiment of the present disclosure. This scan driving circuit may be any one of the scan driving circuits described above. Referring to FIG. 7, this method comprises: step 701: inputting a first start signal to the second shift register before a rising edge of a second clock signal, so that the second shift register starts outputting a second scanning signal, progressively; the second clock signal being one clock signal of a group of clock signals connected to the second shift register; step 702: inputting a second start signal to the first shift register after the rising edge of the second clock signal, so that the first shift register starts outputting a first scanning signal, progressively; and a time that the second scanning signal of any row is converted from a first level to a second level being not later than a time that the first scanning signal of the row starts outputting.

It can be seen that FIG. 5 and its relevant disclosure can be considered as an example of the embodiment of the present disclosure, and thus no further details are provided herein.

Based on the same inventive concept, there is provided in an embodiment of the present disclosure an array substrate, comprising any one of the scan driving circuit described above. For example, this array substrate may be an array substrate of Gate Driver On Array (GOA) type, so that the scan driving circuit comprising a NOR gate circuit as shown in FIG. 4 can be formed on the array substrate. Since this array substrate comprises any one of the scan driving circuits described above, it can solve the same technical problem, and achieve the similar technical effect.

Based on the same inventive concept, there is provided in an embodiment of the present disclosure a display apparatus, comprising any one of the array substrate described above (such as the array substrate of GOA type), or any one of the scan driving circuit described above (for example, being arranged on the circuit board around the array substrate). It needs to note that the display apparatus can be any product or components having a display function, such as a display panel, a mobile phone, a tablet panel computer, a TV set, a notebook computer, a digital photo frame, and a navigator and so on. Since this display apparatus comprise any one of scan driving circuits described above or any one of array substrates described above, it can solve the same technical problem, and achieve the similar technical effect.

It can be known from the above technical solution that the scan driving circuit provided in the present disclosure can generate a compensation signal having a specific wave shape under an appropriate signal timing setting. Exemplarily, the wave shape of the compensation signal within part time coincides with the wave shape of the clock signal, and the wave shape of the compensation signal within other time coincides with the wave shape of the scanning signal, and thus the compensation signal can comprise several pulses of first type (from the clock signal) and one pulse of second type (from the scanning signal), so as to provide a compensation signal required for a variety of OLED pixel circuits.

In the description of the present disclosure, it needs to specify that orientations or position relationship indicated by terms "up", "down", etc. are orientations or position relationship shown based on the figures, and are only used to describe the present disclosure conveniently and simplify the description, but not indicate or suggest the referred apparatus or element must have a specific orientation and must be constructed and operated in a specific orientation, and thereby cannot be understood as a limitation of the present disclosure. Unless otherwise prescribed and limited, terms of "install", "connect" shall be understood broadly, for example, it may be connected fixedly, connected removably, or connected all-in-one; it may be connected mechanically, or connected electrically; it may be connected directly, or connected via an intermediate medium, or connected internally within two elements. For those skilled in the art, the meanings of the terms in the present disclosure can be understood according to the actual situation.

In the specification of the present disclosure, lots of details are described. However, it shall be understood that the embodiments of the present disclosure can be implemented without these details. In some embodiments, the commonly known method, structure and technology are not shown in detail, so as to not blue the understanding of the present specification.

Similarly, it shall be understood that, in order to simplify the present disclosure and help in understanding one or more of the respective aspects of the present disclosure, in the description of exemplary embodiments of the present disclosure, the respective features of the present disclosure are sometimes grouped together into a single embodiment, figure or description thereof. However, the method of the present disclosure shall not be explained as reflecting the following intention: the present disclosure sought for protection claims more features than the features explicitly recited in each claim. More particularly, as reflected in the Claims, the aspects of the present disclosure lies in being less than all of features of a single embodiment described above. Therefore, the Claims conforming to the implementations are thus incorporated into this implementation explicitly, wherein each claim per se is taken as a single embodiment of the present disclosure.

It shall be noted that the above embodiments are descriptions of the present disclosure but not limitation to the present disclosure, and those skilled in the art can design alternative embodiments without departing from the scope of the Claims. In the Claims, any reference signal inside the parentheses shall not be established as a limitation to the claims. A word "include" does not exclude elements or steps not recited in the claims. A word "a" or "one" prior to the elements does not exclude that there are a plurality of such elements. The present disclosure can be implemented by means of hardware comprising several different elements and by means of an appropriately programmed computer. In a unit claim having listed several devices, several of these devices can be reflected by a same hardware. Use of words "first", "second" and "third" and so on does not indicate any sequence, and these words can be explained as names.

Finally, it shall be specified that the respective embodiments described above are only used to describe the technical solution of the present disclosure, but not limit thereto. Although the present disclosure is described in detail by referring to the respective embodiments, those skilled in the art shall understand that technical solutions disclosed in the respective embodiments can still be amended or a part or all of the technical features can be replaced equivalently; these amendments or replacements do not make the corresponding technical solutions depart from the scope of the technical solutions in the respective embodiments, and shall be fallen into the scope of the Claims and specification of the present disclosure.

The present application claims the priority of a Chinese patent application No. 201510217777.8 filed on Apr. 30, 2015. Herein, the content disclosed by the Chinese patent application is incorporated in full by reference as a part of the present disclosure.

What is claimed is:

1. A scan driving circuit, comprising:

a first shift register connected to one group of clock signals having a first clock cycle and configured to output a first scanning signal, progressively, driven by the one group of clock signals;

a second shift register connected to another group of clock signals having a second clock cycle, and configured to output a second scanning signal, progressively, driven by the another group of clock signals; and a logic arithmetic device connected to a first clock signal having a third clock cycle, connected to the first shift register and the second shift register, and configured to output compensation signals of multiple rows;

wherein a compensation signal of any row has a wave shape the same as the first clock signal when the second scanning signal of a present row is at a first level, and has a wave shape the same as the first scanning signal of the present row when the second scanning signal of the present row is at a second level; and the third clock cycle is smaller than the second clock cycle, wherein corresponding to the compensation signal of any row, the logic arithmetic device comprises a first AND arithmetic unit, a second AND arithmetic unit, a NOT arithmetic unit and an OR arithmetic unit, the first AND arithmetic unit is connected to the first clock signal and the second shift register, and configured to perform logic AND arithmetic on the first clock signal and the second scanning signal of the present row, to obtain a first arithmetic signal;

the NOT arithmetic unit is connected to the second shift register, and configured to perform logic NOT arithmetic on the second scanning signal of the present row, to obtain a second arithmetic signal;

the second AND arithmetic unit is connected to the NOT arithmetic unit and the first shift register, and configured to perform logic AND arithmetic on the first scanning signal of the present row and the second arithmetic signal from the NOT arithmetic unit, to obtain a third arithmetic signal; and the OR arithmetic unit is connected to the first AND arithmetic unit and the second AND arithmetic unit and is configured to perform logic OR arithmetic on the first arithmetic signal from the first AND arithmetic unit and the third arithmetic signal from the second AND arithmetic unit, to obtain the compensation signal of the present row.

2. The scan driving circuit according to claim 1, wherein the first shift register comprises multiple stages of first shift register units connected in sequence, and any stage of first shift register unit except for a first stage of first shift register unit is configured to delay and output a first scanning signal of a previous row from a previous stage of shift register unit as the first scanning signal of the present row driven by the one group of clock signals having the first clock cycle;

the second shift register comprises multiple stages of second shift register units connected in sequence, and any stage of second shift register unit except for a first stage of second shift register unit is configured to delay and output a second scanning signal of a previous row from a previous stage of shift register unit as the second scanning signal of the present row driven by the another group of clock signals having the second clock cycle.

3. The scan driving circuit according to claim 2, wherein the logic arithmetic device comprises a plurality of sub logic arithmetic devices, any one of which is corresponding to a stage of the first shift register unit and a stage of the second shift register unit; the sub logic arithmetic device comprises a first transistor, a second transistor, an inverter and an output terminal, a gate of the first transistor is connected to the second scanning signal outputted by the second shift register unit, one of source and drain thereof is connected to the first clock signal having the third clock cycle, and the other is connected to the output terminal;

an input end of the inverter is connected to the second scanning signal outputted by the second shift register unit, and an output end thereof is connected to a gate of the second transistor; and one of source and drain of the second transistor is connected to the first scanning signal outputted by the first shift register unit, and the other is connected to the output terminal.

4. The scan driving circuit according to claim 2, wherein the first shift register unit has a circuit structure the same as the second shift register unit.

5. The scan driving circuit according to claim 1, wherein the one group of clock signals having the first clock cycle comprises m clock signals whose phases have a different of 1/m first clock cycle in sequence;

the another group of clock signals having the second clock cycle comprises n clock signals whose phases have a difference of 1/n second clock cycle in sequence; and both m and n are integers greater than or equal to 2.

6. The scan driving circuit according to claim 5, wherein the third clock cycle, m and n are set according to a wave shape of the compensation signal.

7. A driving method of the scan driving circuit according to claim 1, comprising:

inputting a first start signal to the second shift register before a rising edge of a second clock signal, so that the second shift register starts outputting a second scanning signal, progressively, the second clock signal being one clock signal among a group of clock signals connected to the second shift register; and inputting a second start signal to the first shift register after the rising edge of the second clock signal, so that the first shift register starts outputting a first scanning signal, progressively; and a time that the second scanning signal of any row is converted from a first level to a second level being not later than a time that the first scanning signal of the row starts outputting.

8. An array substrate, comprising the scan driving circuit according to claim 1.

9. A display apparatus, comprising the array substrate according to claim 8.

10. The display apparatus according to claim 9, wherein corresponding to the compensation signal of any row, the logic arithmetic device comprises a first AND arithmetic unit, a second AND arithmetic unit, a NOT arithmetic unit and an OR arithmetic unit, the first AND arithmetic unit is connected to the first clock signal and the second shift register, and configured to perform logic AND arithmetic on the first clock signal and the second scanning signal of the present row, to obtain a first arithmetic signal;

the NOT arithmetic unit is connected to the second shift register, and configured to perform logic NOT arithmetic on the second scanning signal of the present row, to obtain a second arithmetic signal;

the second AND arithmetic unit is connected to the NOT arithmetic unit and the first shift register, and configured to perform logic AND arithmetic on the first scanning signal of the present row and the second arithmetic signal from the NOT arithmetic unit, to obtain a third arithmetic signal; and the OR arithmetic unit is connected to the first AND arithmetic unit and the second AND arithmetic unit and is configured to perform logic OR arithmetic on the first arithmetic signal from the first AND arithmetic unit and the third arithmetic signal from the second AND arithmetic unit, to obtain the compensation signal of the present row.

11. The display apparatus according to claim 9, wherein the first shift register comprises multiple stages of first shift register units connected in sequence, and any stage of first shift register unit except for a first stage of first shift register unit is configured to delay and output a first scanning signal of a previous row from a previous stage of shift register unit as the first scanning signal of the present row driven by the one group of clock signals having the first clock cycle;

the second shift register comprises multiple stages of second shift register units connected in sequence, and any stage of second shift register unit except for a first stage of second shift register unit is configured to delay and output a second scanning signal of a previous row from a previous stage of shift register unit as the second scanning signal of the present row driven by the another group of clock signals having the second clock cycle.

12. The display apparatus according to claim 11, wherein the logic arithmetic device comprises a plurality of sub logic arithmetic devices, any one of which is corresponding to a stage of the first shift register unit and a stage of the second shift register unit; the sub logic arithmetic device comprises a first transistor, a second transistor, an inverter and an output terminal, a gate of the first transistor is connected to the second scanning signal outputted by the second shift register unit, one of source and drain thereof is connected to the first clock signal having the third clock cycle, and the other is connected to the output terminal;

an input end of the inverter is connected to the second scanning signal outputted by the second shift register unit, and an output end thereof is connected to a gate of the second transistor; and one of source and drain of the second transistor is connected to the first scanning signal outputted by the first shift register unit, and the other is connected to the output terminal.

13. The array substrate according to claim 8, wherein corresponding to the compensation signal of any row, the logic arithmetic device comprises a first AND arithmetic unit, a second AND arithmetic unit, a NOT arithmetic unit and an OR arithmetic unit, the first AND arithmetic unit is connected to the first clock signal and the second shift register, and configured to perform logic AND arithmetic on the first clock signal and the second scanning signal of the present row, to obtain a first arithmetic signal;

the NOT arithmetic unit is connected to the second shift register, and configured to perform logic NOT arithmetic on the second scanning signal of the present row, to obtain a second arithmetic signal;

the second AND arithmetic unit is connected to the NOT arithmetic unit and the first shift register, and configured to perform logic AND arithmetic on the first scanning signal of the present row and the second arithmetic signal from the NOT arithmetic unit, to obtain a third arithmetic signal; and the OR arithmetic unit is connected to the first AND arithmetic unit and the second AND arithmetic unit and is configured to perform logic OR arithmetic on the first arithmetic signal from the first AND arithmetic unit and the third arithmetic signal from the second AND arithmetic unit, to obtain the compensation signal of the present row.

14. The array substrate according to claim 8, wherein the first shift register comprises multiple stages of first shift register units connected in sequence, and any stage of first shift register unit except for a first stage of first shift register unit is configured to delay and output a first scanning signal of a previous row from a previous stage of shift register unit as the first scanning signal of the present row driven by the one group of clock signals having the first clock cycle;

the second shift register comprises multiple stages of second shift register units connected in sequence, and any stage of second shift register unit except for a first stage of second shift register unit is configured to delay and output a second scanning signal of a previous row from a previous stage of shift register unit as the second scanning signal of the present row driven by the another group of clock signals having the second clock cycle.

15. The array substrate according to claim 14, wherein the logic arithmetic device comprises a plurality of sub logic arithmetic devices, any one of which is corresponding to a stage of the first shift register unit and a stage of the second shift register unit; the sub logic arithmetic device comprises a first transistor, a second transistor, an inverter and an output terminal, a gate of the first transistor is connected to the second scanning signal outputted by the second shift register unit, one of source and drain thereof is connected to the first clock signal having the third clock cycle, and the other is connected to the output terminal;

an input end of the inverter is connected to the second scanning signal outputted by the second shift register unit, and an output end thereof is connected to a gate of the second transistor; and one of source and drain of the second transistor is connected to the first scanning signal outputted by the first shift register unit, and the other is connected to the output terminal.

16. The array substrate according to claim 14, wherein the first shift register unit has a circuit structure the same as the second shift register unit.

17. The array substrate according to claim 8, wherein the one group of clock signals having the first clock cycle comprises m clock signals whose phases have a different of 1/m first clock cycle in sequence;

the another group of clock signals having the second clock cycle comprises n clock signals whose phases have a difference of 1/n second clock cycle in sequence; and both m and n are integers greater than or equal to 2.

18. The scan driving circuit according to claim 17, wherein the third clock cycle, m and n are set according to a wave shape of the compensation signal.

19. The scan driving circuit according to claim 1, wherein the first shift register comprises multiple stages of first shift register units connected in sequence, and any stage of first shift register unit except for a first stage of first shift register unit is configured to delay and output a first scanning signal of a previous row from a previous stage of shift register unit as the first scanning signal of the present row driven by the one group of clock signals having the first clock cycle;

the second shift register comprises multiple stages of second shift register units connected in sequence, and any stage of second shift register unit except for a first stage of second shift register unit is configured to delay and output a second scanning signal of a previous row from a previous stage of shift register unit as the second scanning signal of the present row driven by the another group of clock signals having the second clock cycle.

* * * * *